United States Patent [19]

Jolly

[11] 3,935,899

[45] Feb. 3, 1976

[54] INTEGRATED THERMAL ENERGY CONTROL SYSTEM USING A HEAT PUMP

[76] Inventor: Steven E. Jolly, P.O. Box 834, Ely, Nev. 89301

[22] Filed: June 28, 1974

[21] Appl. No.: 484,090

[52] U.S. Cl. ..... 165/29; 165/50; 165/62

[51] Int. Cl.[2] ..... F25B 29/00

[58] Field of Search ..... 165/50, 22, 29, 62, 27; 62/393

[56] References Cited

UNITED STATES PATENTS

| | | | |
|---|---|---|---|
| 2,492,757 | 12/1949 | Meek | 165/50 |
| 2,557,035 | 6/1951 | Lichty | 165/50 |
| 2,596,195 | 5/1952 | Arbuckle | 62/393 |
| 3,069,867 | 12/1962 | Ringquist | 165/29 |

*Primary Examiner*—Charles J. Myhre
*Assistant Examiner*—William C. Anderson
*Attorney, Agent, or Firm*—Mills and Coats

[57] ABSTRACT

The present invention relates to an integrated thermal energy control system for heating and cooling simultaneously or separately a plurality of hot or cool working units, the hot and cool working units corresponding to hot and cold appliances and energy units customarily performing a supporting fuction in a dwelling design or being an appliance customarily used in a structure or a household. To heat or cool these working units, a heat pump is provided and has associated therewith a primary fluid circuit means having a working fluid for heating and cooling a fluid contained in two heat exchangers, the heat exchangers being referred to as a hot heat exchanger or a heat transfer tank and a cool heat exchanger or a cool transfer tank. Each heat exchanger has associated therewith a secondary fluid circuit means that is operatively connected to respective working units, in one case the secondary fluid circuit associated with the hot heat exchanger is operatively connected to hot working units or appliances while in the other case the secondary fluid circuit associated with the cool heat exchanger is operatively connected to cool working units or appliances.

12 Claims, 3 Drawing Figures

INTEGRATED THERMAL ENERGY CONTROL SYSTEM USING A HEAT PUMP

The present invention relates to heating and cooling systems and more particularly to an integrated thermal energy control system for controlling a plurality of appliances or energy working units of both the hot and cold type with the system being particularly adapted to control the hot and cold units either simultaneously or separately.

BACKGROUND OF THE INVENTION

In homes and building structures of today, one typically finds such provided with a heating system adapted both to heat and cool the particular structure. In addition, especially in the case of a dwelling or home structure, it is quite common to have numerous hot and cold appliances or working units in the home. For example, one might find any one of the following appliances or working units in a household: water heater, room heater, freezer, air conditioner, clothes dryer, or refrigerator. In such appliances, one finds that they all are provided with their own heating or cooling mmeans. This, of course, means that such appliances or working units operate independently of other such appliances or working units and that substantial duplication exist relative to the numerous heating and cooling means.

At the present time, people are very energy conscious and there is considerable energy conservation movement here in the United States as well as all over the world. In providing a system where the individual hot and cold working units each have their own heating or cooling means, one finds that this type of system is inherently inefficient. This is because of the great amount of duplication presented by providing separate heating and cooling means for each working unit when all of the working units could be seved by a single central heat pump. In addition, in a system where the working units are independent of each other, there is no opportunity to harness and take advantage of the thermal energy given off as waste heat by the individual units. For example, in cooling, an air conditioner gives off heat that could be utilized by a hot appliance or working unit. Therefore, it is appreciated that if the individual hot and cold units were integrated into a single system that the thermal energy given off by each of the working units could be utilized by other working units of the system, thereby greatly increasing the overall efficiency of the total energy using system.

SUMMARY OF THE INVENTION

The present invention presents an integrated thermal energy control system having a plurality of appliances or working units incorporated therein, the appliances or working units being of both or either the hot and/or cold type. Thermal energy is transferred by a single heat pump which includes a primary fluid circuit associated therewith and operative to transfer heat with respect to both a hot and cold heat exchanger. Each heat exchanger has operatively associated therewith a secondary fluid circuit which has connected therein a plurality of individual appliances or working units, the hot appliances or working units being in the secondary fluid circuit associated with the hot heat exchanger while cold or cool appliances or working units are connected in the secondary fluid circuit associated with the cold or cool heat exchanger. Thermostatic control is provided between the central heat pump of the integrated thermal energy control system and each of the two heat exchangers for maintaining the heat exchangers at a desired and predetermined temperature level. In addition, thermostatic control means is operatively connected to each of the appliances or working units and to a pump in each respective secondary fluid circuit for controlling the operating temperature of each of the appliances or working units. Therefore, it is seen that the integrated thermal energy control system of the present invention is adapted to simultaneously or separately control a plurality of hot and cold appliances or working units. Also, it should be noted that the thermal energy control system of the present invention is an integrated system and is particularly adapted to utilize the thermal energy given off by various appliances or working units of the system, with the thermal energy given off being utilized by other appropriate working units or appliances.

There may be occasions where only the hot or cold portion of the integrated system is working, and it is advantageous to provide a heat balancing system for either adding heat to the working fluid of the primary circuit or exhausting heat from the working fluid of the primary circuit. In the present case, this is accomplished by the provision of two heat transfer duct assemblies, one duct assembly being referred to as a heat exhaust duct assembly while the other is referred to as a heat addition duct assembly. This enables the entire system to remain in balance and enables control to be precisely exercised over each of the heat transfer tanks associated with the primary fluid circuit means.

With respect to use, the thermal energy control system of the present invention cannot only be used in controlling temperatures within dwellings and other structures, but also has application in industrial uses having multiple working units wherein it is desired to provide thermal energy transfer to or from the working units and to provide high or low temperature control of each working unit.

It is, therefore, an object of the present invention to provide an efficient integrated thermal energy control system for controlling a plurality of both hot and cold appliances or working units within a single system.

A further object of the present invention is to provide a thermal control system for supplying and transferring energy in the form of heat to or from a plurality of appliances or working units operatively connected within the system, and wherein the thermal energy of the system is transferred by a heat pump.

Still a further object of the present invention is to provide a symmetrically balanced thermal energy control system for controlling simultaneously or separately a plurality of hot and cold appliances or working units.

A further object of the present invention is to provide an integrated thermal energy control system adapted to control a plurality of hot and cold appliances or working units, and to provide that integrated thermal energy control system with a control heat balancing system for adding or exhausting heat to or from a primary fluid circuit associated with the heat pump.

A further object of the present invention is to provide a thermal energy control system adapted to be used within a structure of family dwelling that gives the structure or dwelling flexibility in that various appliances or working unis may be integrated and placed into the total system as they become desired and available.

A further object of the present invention resides in the provision of an integrated thermal energy control system for controlling a plurality of both hot and/or cold appliances or working units wherein the appliances or working units may be centrally controlled by a simple control system.

A further object of the present invention resides in the provision of an integrated thermal control system that utilizes the energy given off by various appliances or working units within the system to effectively operate other appliances or working units within the same system.

Other objects and advantages of the present invention will become apparent from a study of the following description and the accompanying drawings which are merely illustrative of the present invention.

DESCRIPTION OF THE PREFERRED EMBODIMENT

Figure 1:
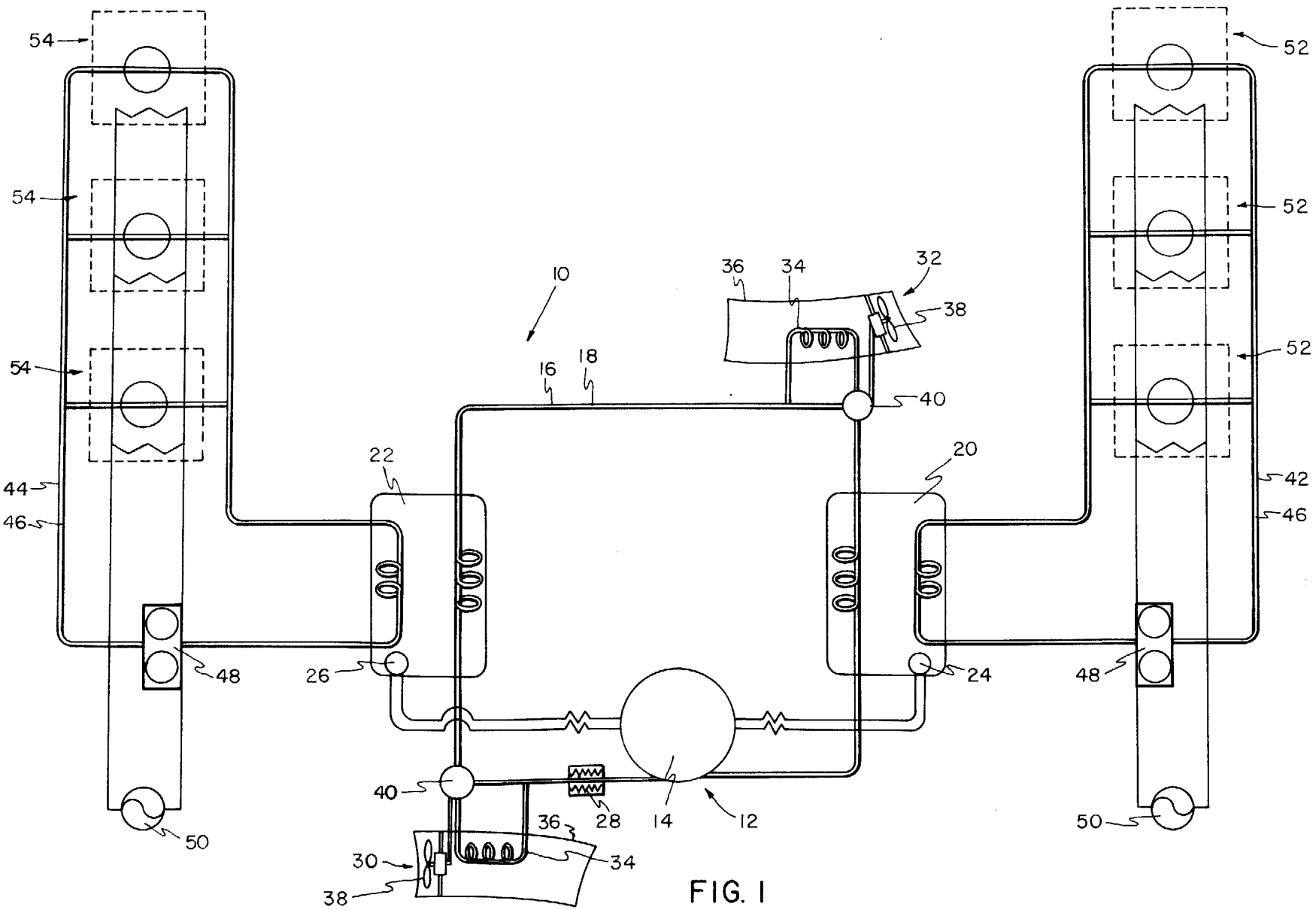
FIG. 1 is a schematic illustration of the thermal energy control system of the present invention particularly showing the thermal energy control system controlling a plurality of both hot and cold appliances or working units.

With further reference to the drawings, particularly FIG. 1, there is shown therein a schematic illustration of the integrated thermal energy control system of the present invention, the integrated thermal energy control system being referred to generally by the numeral 10. Viewing the integrated thermal energy control system 10 in greater detail, it is seen that the same comprises a central heat pump unit 12. Heat pump unit 12 includes a motor and compressor unit 14 having a closed looped primary circuit 16 operatively connected thereto, the primary circuit 16 including a working fluid 18 contained therein.

Primary circuit 16 is coiled in two areas and each coiled area extends through one of two heat transfer or exchanger tanks 20 and 22, heat transfer tank 20 being referred to as a hot transfer tank while heat transfer tank 22 is referred to as a cold transfer tank. Each transfer tank 20, 22 contains a fluid which serves two purposes: (1) it facilitates heat transfer between primary and secondary circuits and (2) it provides a heat or cold storage capacity so that the heat pump need not run continuously. There is provided in each heat transfer tank a thermostat (the thermostat in the hot tank is referred to by the numeral 24 while the thermostat in the cold tank is referred to by the numeral 26) which is operatively connected to the heat pump 12 and adapted to sense the temperature within the respective heat transfer tank and to control the heat pump 12 such that a predetermined temperature level is maintained in the respective heat transfer tank. The heat pump 12 will operate if either or both thermostats 24 or 26 is sending a signal to the heat pump. When both transfer tanks are at the proper temperature, no signal is sent to the heat pump, and it does not operate.

Also provided within the primary circuit 16 is a heat booster 28 which may be of the electric coil type or any other type which has the capability to add auxiliary heat to the working fluid 18 of the primary circuit 16. In this regard it will be appreciated by those skilled in the art that conventional heat pumps require such a heat booster when the outside or ambient temperature drops below a certain level and it is desired to maintain an inside warm or hot temperature with the heat pump.

A detailed discussion of the heat pump 12 is not presented herein because the structure thereof is well known to those skilled in the art and details of such is not material to the present invention. However, it is believed that a heat pump of the Stirling cycle type would be particularly desirable for the application suggested by the present invention due to the efficiency and capacity of the Stirling cycle heat pump.

Associated with the primary circuit 16 is a heat addition duct assembly 30 and a heat exhaust duct assembly 32. The purpose of each of these duct assemblies is to add or exhaust heat from the primary fluid circuit 16 as necessary to control the temperature of either or both of the heat transfer tanks 20 and 22. In addition, the heat duct assemblies 30 and 32 may be used for subcooling and superheating as is conventional in other types of heating and cooling systems. Viewing each duct assembly in greater detail, it is seen that the same comprises an air duct 36 having a coil 34 operatively connected to the fluid circuit 16 and extending through the duct 36 where the coil is disposed interiorly of the duct. Also provided is a fan 38 which is operatively connected to a thermostat control 40 provided between the coil 34 and the primary circuit 16. If heat is being transferred away from the hot transfer tank 20 to the associated secondary circuit, then because of the nature of the heat pump 12 and its relationship with the integrated thermal energy control system 10 of the present invention, heat is being simultaneously extracted and transferred from the cold transfer tank 22 to the primary circuit. As heat is continually transferred from the cold transfer tank 22, it follows that the fluid therein becomes cooler. Once a predetermined temperature is reached in the cold transfer tank 22, then the thermostat control 40 of the heat addition duct assembly 30 is actuated and the working fluid 18 is diverted through the coil 34 and since the fan is operated heat is added to the fluid passing therethrough to balance the system.

Conversely, if the cold heat transfer tank 22 is actively cooling the associated secondary circuit and the hot transfer tank 20 is not in use and is not actively heating the associated secondary circuit, then there is no need to exhaust this excess heat leaving the hot transfer tank 22 in order that the temperature in the hot transfer tank does not move above a predetermined temperature level. In such a case, the thermostatic control 40 associated with the heat exhaust duct assembly 32 is actuated and the working fluid 18 of the primary circuit 16 is diverted through the coil 34 within the duct 36. The fan thereof pulls a system of air through the duct 36 and this system of air acts to cool and exhaust heat from the working fluid 18 passing through the coil 34. Consequently it is appreciated that heat exhaust duct assembly 32 acts as a part of the heat balancing system to maintain the hot heat transfer tank 20 at a predetermined temperature level.

Operatively associated with the hot and cold heat transfer tanks 20 and 22 are a pair of secondary fluid circuits 42 and 44, respectively. Each of these secondary fluid circuits 42 and 44 is previously constructed of insulated tubing and includes a working fluid 46 incorporated therein and have a portion thereof coiled through the respective heat transfer tank associated therewith. In addition, each secondary fluid circuit includes a pump 48 operatively connected therein and adapted to pump the working fluid 46 therethrough. Each pump 48 is preferably of the variable flow type and is current responsive for controlling the flow of fluid through the particular secondary circuit in response to changes in the current from a power source 50.

Connected in parallel relationship in each of the secondary circuits 42 and 44 is a plurality of hot appliances or working units 52 and cold appliances or working units 54. It is seen that the appliances or working units connected in the cold secondary fuid circuit 44 are of the type that requires cooling and include, for example, an air conditioner, refrigerator and freezer. On the other hand, connected in the hot secondary fluid circuit 42 are what are termed hot appliances or working units and include, for example, a hot water heater, clothes dryer and room heater.

Figure 2:
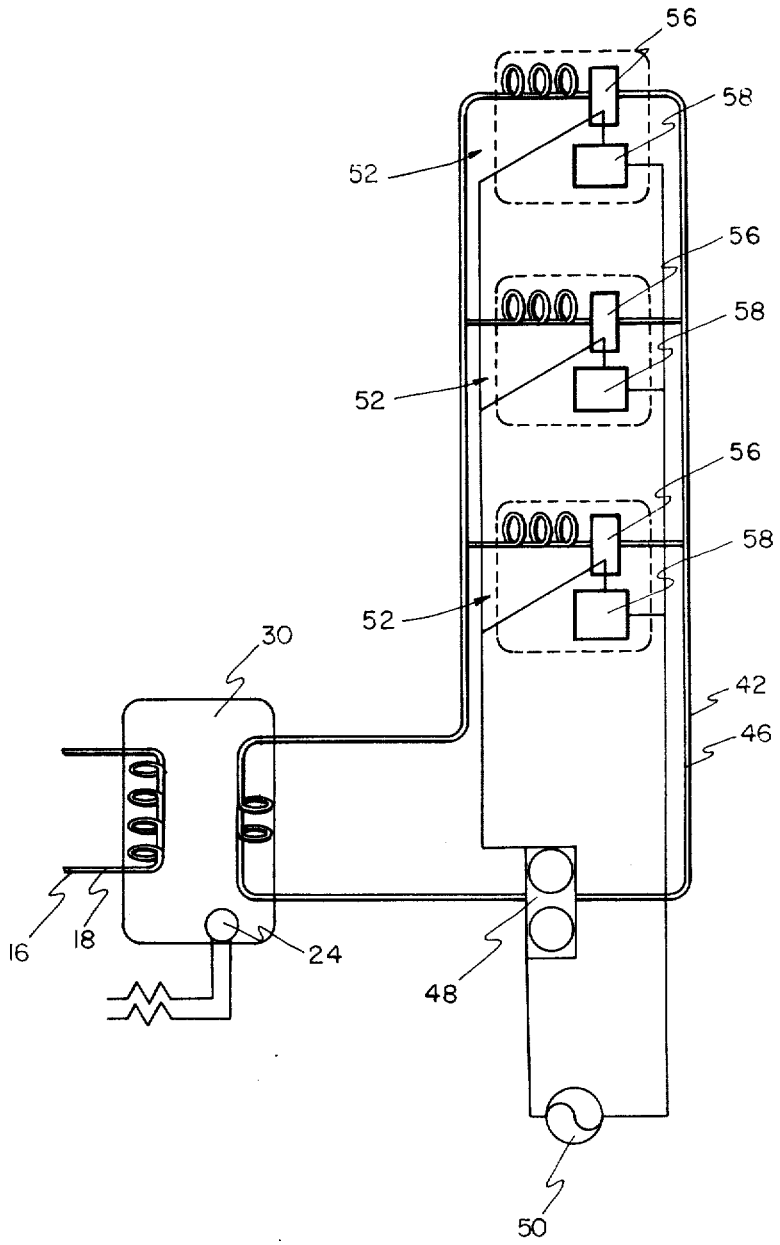
FIG. 2 is a schematic illustration of a particular secondary fluid circuit having associated therewith a plurality of appliances or working units with control means for controlling the operating temperature of each.

Turning to FIG. 2, a secondary fluid circuit is illustrated therein and there is shown a series of appliances or working units with a control system for maintaining each appliance or working unit at a predetermined temperature level. In this regard, it is seen that in the case of each appliance or working unit, there is provided a solenoid valve 58 operatively connected between a coil within the appliance or working unit system and the particular secondary fluid circuit. Operatively associated with the solenoid valve 58 is a thermostat 56 that is preset to maintain the particular appliance or working unit at a predetermined temperature level, the thermostat being operatively connected to the pump 48 within the secondary fluid circuit for actuating the same with respect to the preset temperature for that particular appliance or working unit. In operation, once the thermostat 56 senses the operating temperature of the appliance or working unit is above or below the preset temperature, the thermostat opens the solenoid valve 58 and also acts to actuate the pump 48 of the pump is not already operating due to actuation by another thermostat of the integrated thermal energy control system. Therefore, the pump 48 serves to pump the working fluid 46 to the particular appliance or working unit and it follows that there is effectuated a heat transfer between that particular appliance and the particular heat transfer tank 20 or 22 associated therewith. It also follows that from that particular heat transfer tank, that the thermal energy associated therewith is transferred between that same heat transfer tank and the primary fluid circuit 16. In addition, it is appreciated that because of the presence of the hot and cold portions of the integrated thermal energy control system 10 of the present invention that this total system acts to transfer energy between the hot and cold portions and the thermal energy given off by one portion thereof may be efficiently used by another portion of the same system.

Figure 3:
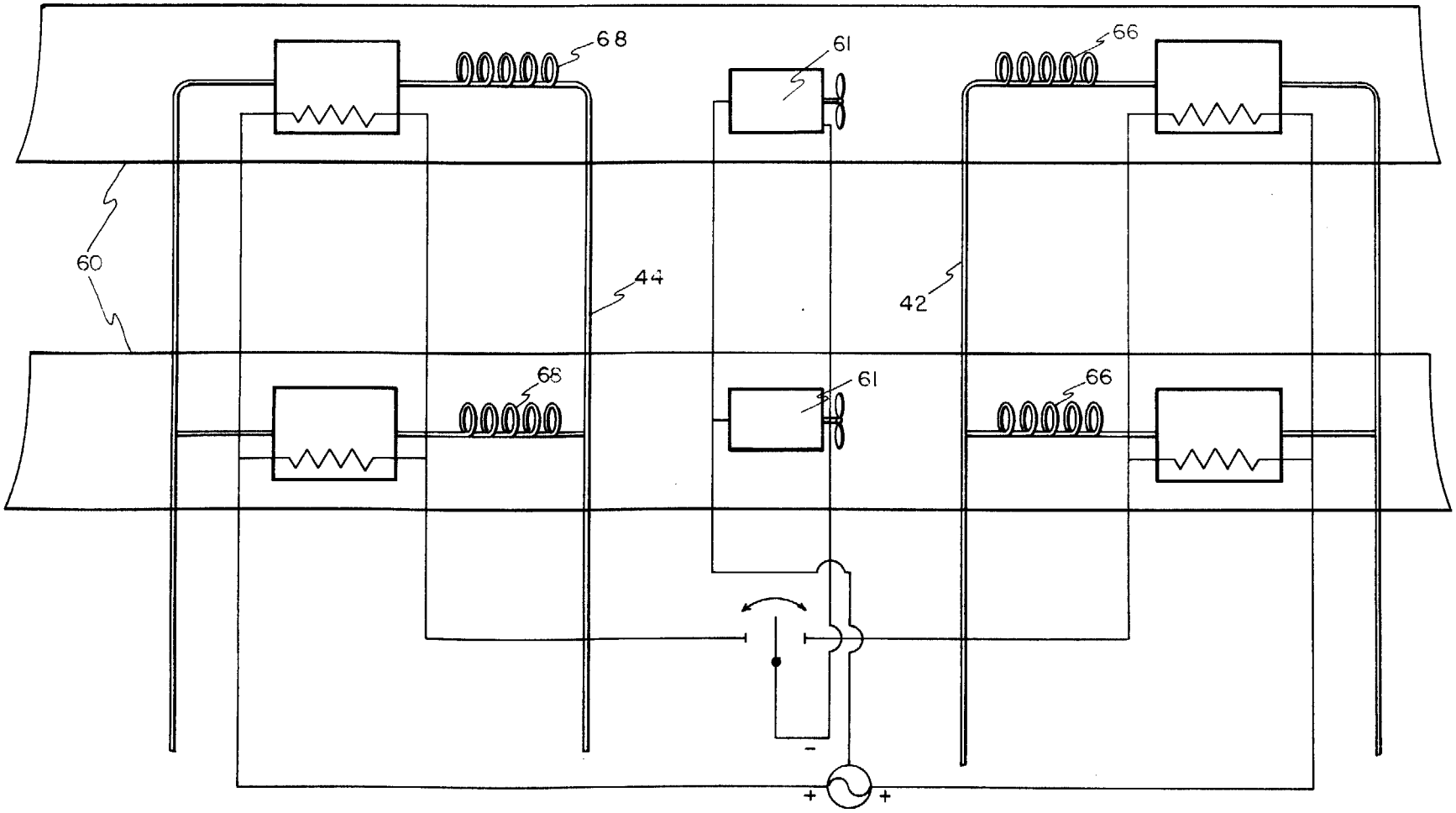
FIG. 3 is a schematic illustration of a room heating and cooling apparatus of the type adapted to be thermally controlled by the integrated thermal energy control system of the present invention.

In FIG. 3, there is a schematic illustration of a room heating and cooling apparatus which represents an appliance or working unit that is adapted to be integrated into the thermal energy control system 10 of the present invention. Viewing this structure in detail, it is seen that there is illustrated a pair of air ducts 60, with each air duct including a fan 61 for generating a system of passing forced air within each air duct. This room heating and cooling system includes a hot working unit fluid circuit 62 and a cold working unit fluid circuit 64.

The hot working unit fluid circuit includes a pair of hot coils 66 while the cold working unit fluid circuit includes a pair of cooling coils 68. The hot and cold working unit fluid circuits 62 and 64 are integrated for control purposes by a combination thermostat switch 70. It, of course, is seen that each of the working unit fluid circuits 62 and 64 are supplied by their respective secondary fluid circuits discussed hereinbefore. It also is seen that the closing of the combination thermostat 70 to the right (as viewed in FIG. 3) results in the hot coils of fluid circuit 62 being actuated and since the fans 61 are simultaneously actuated, it is seen that this system produces heat that is exhausted through the ducts 60. Likewise, the movement of the switching arm of the combination thermostat 70 to the left (as viewed in FIG. 3) results in the cool coils 68 being actuated and the system producing a cool air system through the duct for air conditioning purposes.

Therefore, in summary, it is seen that the integrated thermal energy control system 10 of the present invention is adapted to control both a plurality of hot and cold appliances or working units with only a single thermal energy transfer means. Also, it is appreciated that the thermal energy given off by the various appliances or working units of the integrated thermal energy control system can be harnessed and used by other appliances or working units of the same system. Consequently, these two aspects of the present invention give rise to a very efficient thermal energy control system for transferring and delivering energy to various thermal energy consuming units within a dwelling or other type of structure.

It should be pointed out that individual appliances or working units could be provided with fans to further control the rate of heat transfer in the appliance. In addition, for defrost purposes, the various cold appliances could be provided with conventional electric heating wires and timing controls therefor.

For the purpose of simplicity the disclosure herein has dealt with only the vapor-condensation cycle heat pump. It is obvious to those skilled in the art that with a Stirling cycle heat pump or other device wherein the working fluid remains exclusively inside the machine, two separate primary circuits may be used - one connected to the hot side of the heat pump and one to the cold side. In such cover the flow pattern is otherwise the same, i.e., from the heat pump to the transfer tank and heat balancing duct back to the heat pump. It should also be noted that as used herein the reference to "heat pump" is intended to encompass and mean any device capable of producing temperature above and below ambient temperatures.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. An integrated thermal energy control system for thermally heating and cooling a plurality of independent cool and hot working units operatively connected within the system, said integrated thermal energy control system comprising:

a. a heat pump means for cooling and heating a working fluid;

b. said heat pump means having associated therewith a primary fluid circuit means having said working fluid contained therein;

c. a first relatively cool heat exchange means operatively associated with said primary circuit means;

d. a first temperature control means operatively interconnected between said heat pump means and first heat exchanger means for maintaining a relatively cool temperature within said first heat exchanger means;

e. a second relatively hot heat exchanger means operatively associated with said primary circuit means;

f. second temperature control means operatively interconnected between said heat pump means and said second heat exchanger means for maintaining a relatively hot temperature within said first heat exchanger means;

g. a first secondary cool fluid circuit means operatively associated with said first heat exchanger means independently of said primary fluid circuit for effectively transferring heat from said secondary cool circuit means to said first heat exchanger means such that the fluid within said secondary cool circuit means is cooled during the heat transfer process;

h. a plurality of independent cool working unit means operatively connected to said first secondary cool fuid circuit means for transferring heat thereto and being cooled in the process;

i. a second secondary hot fluid circuit means operatively associated with second heat exchanger means independently of said primary fluid circuit for receiving heat therefrom and consequently tending to cool said second heat exchanger means in the process;

j. a plurality of independent hot working unit means, completely independent of said cool working unit means, operatively connected to said secondary hot fluid circuit means for receiving heat therefrom;

k. control means associated with both said first and second secondary circuit means for enabling both said first and second secondary circuit means to function simultaneously and to simultaneously effectuate heat transfer between the two secondary circuits and respective independent cool and hot working unit means of the system, and control means including first secondary pump means and first control means operatively interconnected between at least one of said independent cool working unit means and said first secondary pump means for maintaining the working temperature of each respective cool working unit means at a desired level, said control means further including second secondary pump means and second control means operatively interconnected between at least one of said hot working unit means and said second secondary pump means for maintaining the working temperature of each respective hot working unit means at a desired level.

2. The integrated thermal energy control system of claim 1 wherein said heat pump means includes a motor and compressor unit, and wherein said primary fluid circuit means is connected to said motor and compressor unit to form at least one closed loop system and wherein said primary fluid circuit means extends through both said cool heat exchanger means and said hot exchanger means and is operatively associated with each to effectuate heat transfer therebetween.

3. The integrated thermal energy control system of claim 1 wherein said heat pump means includes an auxiliary heat booster means for increasing the heating capacity of said heat pump means.

4. The integrated thermal energy control system of claim 1 including a heat balancing system for adding and exhausting heat to and from said primary fluid circuit means.

5. The integrated thermal energy control system of claim 4 wherein said heat balancing system includes a heat exhaust duct assembly and a heat addition duct assembly, each duct assembly including a coil operatively connected to said primary fluid circuit means and a fan for generating and forcing a system of air over said coil.

6. The integrated thermal energy control system of claim 5 wherein said heat exhaust duct assembly of said heat balancing system includes control means associated therewith responsive at least indirectly to the temperature in said hot heat exchanger means for actuating said heat exhaust duct assembly of said heat balancing system.

7. The integrated thermal energy control system of claim 6 wherein said heat addition duct assembly of said heat balancing system includes control means responsive at least indirectly to the temperature in said cool heat exchanger means for actuating said heat addition duct assembly of said heat balancing system.

8. The integrated thermal energy control system of claim 7 wherein said control means of said heat balancing system that is responsive to the temperature of said cool and hot heat exchanger means includes a thermostat control valve operatively interconnected between said primary fluid circuit means and the respective coils of said heat balancing system.

9. The integrated thermal energy control system of claim 1 wherein said first and second control means operatively interconnected between said hot and cold working units and their respective secondary fluid circuit means comprises:

a. a pump associated with each secondary fluid circuit means for circulating a secondary working fluid therethrough;

b. valve means operatively interconnected between each working unit and the respective secondary fluid circuit means; and c. control means operatively connected to each working unit for causing secondary fluid flow to said working units in response to the operation temperature of each working unit reaching a predetermined level.

10. The integrated thermal energy control system of claim 9 wherein said valve means is of the solenoid type and wherein said control means includes a thermostat operatively connected to both said pump and said solenoid valve.

11. The integrated thermal energy control system of claim 10 wherein said working units of each secondary fluid circuit means are operatively connected therein in parallel relationship.

12. The integrated thermal energy control system of claim 11 wherein said heat pump means is of the Stirling cycle type.

* * * * *